US009385416B2

(12) United States Patent
Govindasamy et al.

(10) Patent No.: US 9,385,416 B2
(45) Date of Patent: Jul. 5, 2016

(54) THREE DIMENSIONAL ANTENNA DOME ARRAY

(71) Applicants: Gururaj Govindasamy, San Ramon, CA (US); Hogan Lew, Sunnyvale, CA (US); Prakash Guda, Fremont, CA (US); Stephen H. Strong, Fremont, CA (US); Thien T. Nguyen, Fremont, CA (US)

(72) Inventors: Gururaj Govindasamy, San Ramon, CA (US); Hogan Lew, Sunnyvale, CA (US); Prakash Guda, Fremont, CA (US); Stephen H. Strong, Fremont, CA (US); Thien T. Nguyen, Fremont, CA (US)

(73) Assignee: ARUBA NETWORKS, INC., Sunnyvale, CA (US)

( * ) Notice: Subject to any disclaimer, the term of this patent is extended or adjusted under 35 U.S.C. 154(b) by 518 days.

(21) Appl. No.: 13/742,227

(22) Filed: Jan. 15, 2013

(65) Prior Publication Data

US 2014/0197998 A1 Jul. 17, 2014

(51) Int. Cl.

| | |
|---|---|
| ***H01Q 1/42*** | (2006.01) |
| ***H01Q 1/24*** | (2006.01) |
| ***H01Q 1/00*** | (2006.01) |
| ***H01Q 1/02*** | (2006.01) |
| ***H01Q 21/24*** | (2006.01) |
| ***H01Q 21/29*** | (2006.01) |

(52) U.S. Cl.

CPC ..... *H01Q 1/24* (2013.01); *H01Q 1/007* (2013.01); *H01Q 1/02* (2013.01); *H01Q 21/24* (2013.01); *H01Q 21/29* (2013.01)

(58) Field of Classification Search

CPC ..... H01Q 1/24; H01Q 1/007; H01Q 21/29; H01Q 21/24; H01Q 1/02

USPC ..... 343/702, 872, 893

See application file for complete search history.

(56) References Cited

U.S. PATENT DOCUMENTS

2011/0102281 A1* 5/2011 Su ..... 343/742
2012/0155015 A1* 6/2012 Govindasamy et al. . 361/679.46

* cited by examiner

*Primary Examiner* — Dieu H Duong
(74) *Attorney, Agent, or Firm* — Hewlett Packard Enterprise Patent Department

(57) ABSTRACT

According to one embodiment of the invention, a wireless network device comprises wireless logic and a heat dissipation unit that encases the wireless logic. The heat dissipation unit includes an antenna dome array that comprises a top surface having a convex-shaped outer periphery with a plurality of antenna elements positioned along the outer periphery.

16 Claims, 6 Drawing Sheets

FIG. 5
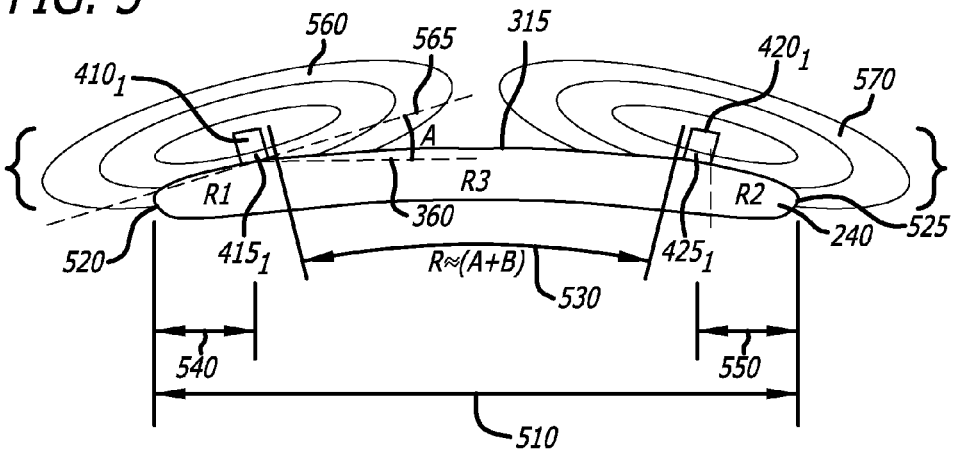
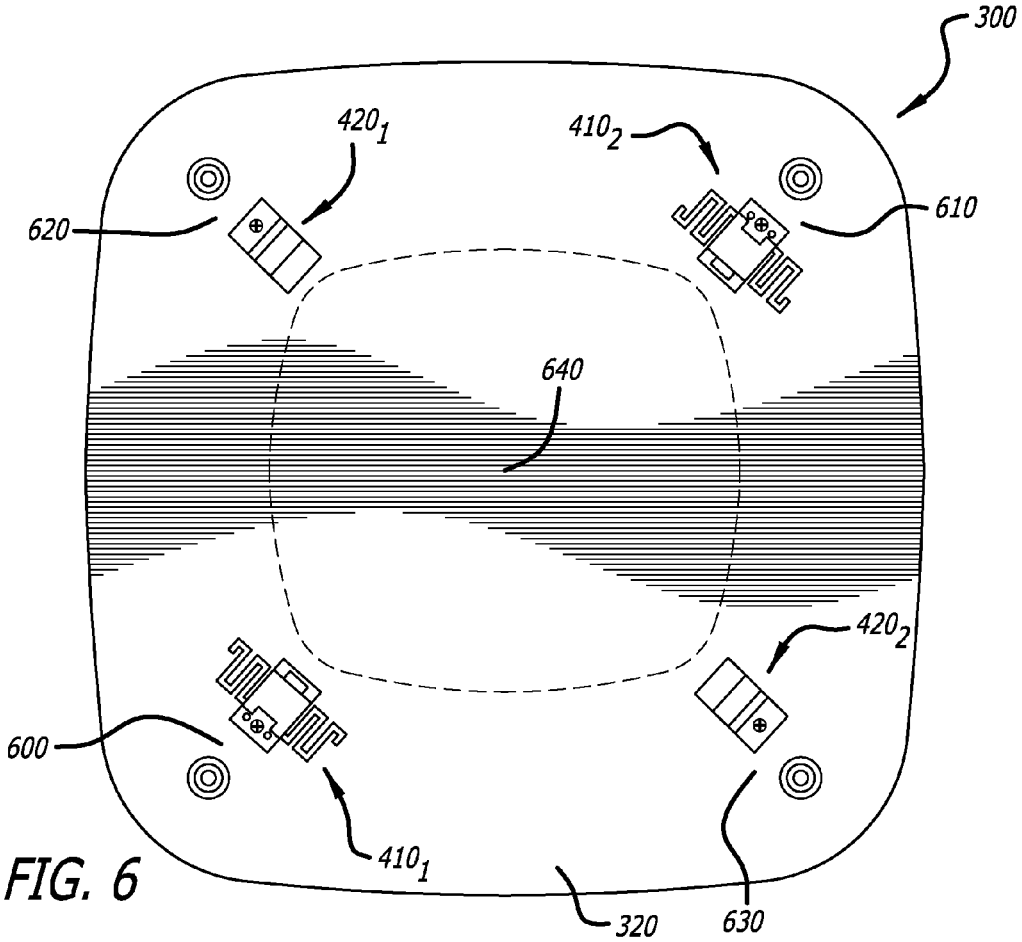
FIG. 6

THREE DIMENSIONAL ANTENNA DOME ARRAY

FIELD

Embodiments of the disclosure relate to the field of communications, and in particular, to a wireless network device adapted with an antenna configuration for improved spatial/pattern diversity and/or spatial polarization.

GENERAL BACKGROUND

Over the last decade or so, electronic devices responsible for establishing and maintaining wireless connectivity within a wireless network have increased in complexity. For instance, wireless electronic devices now support greater processing speeds and greater data rates. As a by-product of this increase in complexity, radio communications techniques have evolved with the emergence of multiple-input and multiple-output (MIMO) antenna architectures.

In general, MIMO involves the use of multiple antennas operating as transmitters and/or receivers to improve communication performance. Herein, multiple radio channels are used to carry data within radio signals transmitted and/or received via multiple antennas. As a result, in comparison with other conventional antenna architectures, MIMO antenna architectures offer significant increases in data throughput and link reliability (reducing fading) without increased transmit power.

Currently, in wireless access points for example, MIMO antennas are deployed on a flat surface commonly used as a heat sink. This deployment fails to optimize spatial diversity, polarization diversity or pattern diversity in order to optimize antenna performance.

BRIEF DESCRIPTION OF THE DRAWINGS

The disclosure may best be understood by referring to the following description and accompanying drawings that are used to illustrate embodiments of the disclosure.

FIG. 5 is a cross-sectional view of the antenna dome array of FIG. 4 along lines 5-5.

FIG. 6 is a perspective view of a second exemplary embodiment of the antenna dome array of FIG. 3.

DETAILED DESCRIPTION

Figure 1:
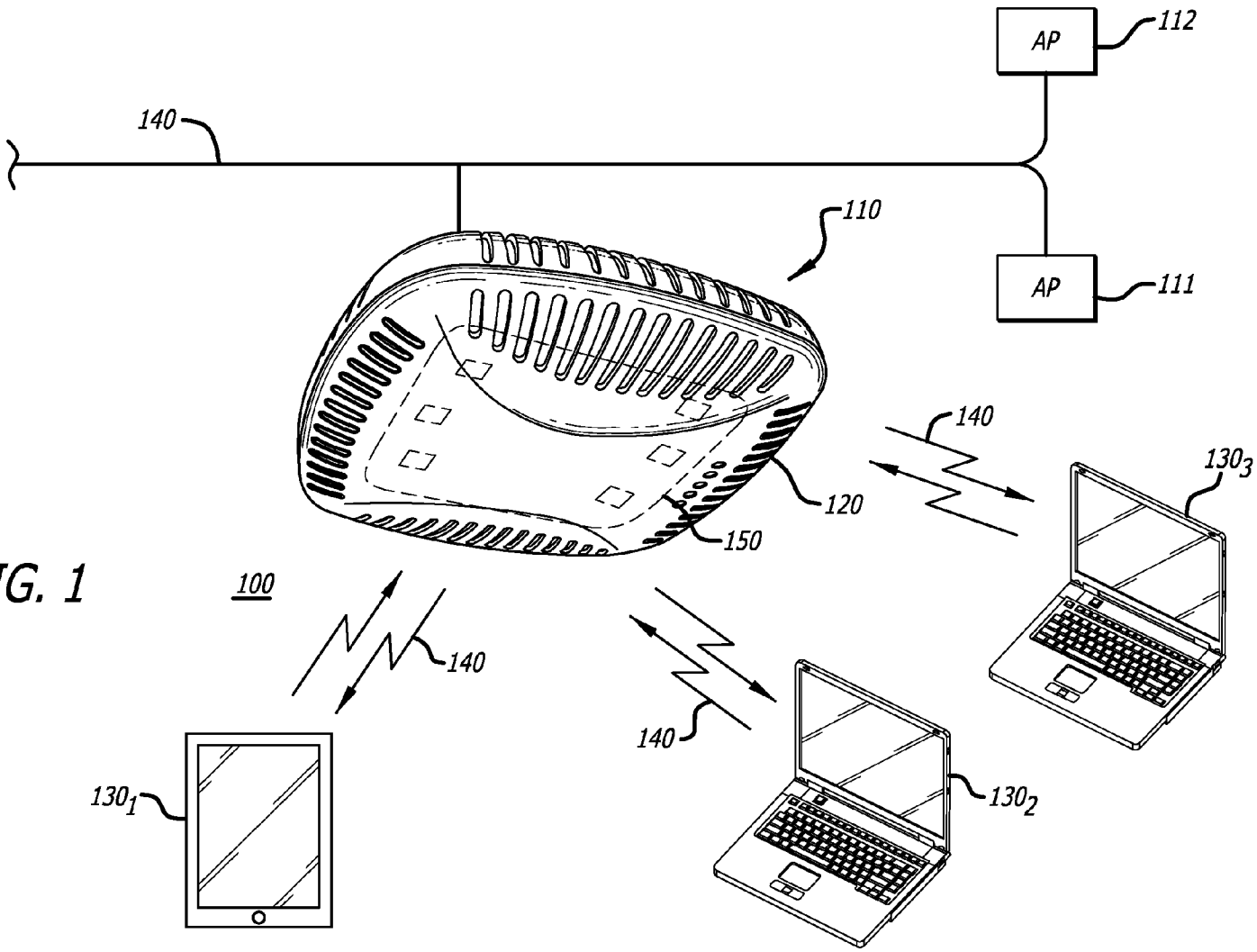
FIG. 1 is an exemplary embodiment of a wireless network including a wireless network device deploying a three dimensional antenna dome array.

Embodiments of the disclosure relate to a wireless network device adapted with an antenna dome array. Besides operating as a cover for a heat dissipation unit that protects wireless logic from environmental effects and dissipates heat generated by the wireless logic by convection, the antenna dome array also provides a surface for multiple antenna elements. These antenna elements are positioned to provide a greater angular diversity for the antenna patterns radiating from these antenna elements.

According to one embodiment of the disclosure, the antenna dome array comprises a downward curved, outer periphery (having a general convex shape) onto which multiple antenna elements are placed. In communication with wireless logic, these antenna elements are positioned to achieve improved spatial diversity, polarization and pattern diversity. The antenna dome array may be shaped to feature a convex-shaped top surface with different radius of curvature through different segments of the antenna dome array (e.g. a higher radius of curvature toward a center area with convex-shaped top surface with a lesser radius of curvature at the outer periphery).

In particular, improved spatial diversity may be achieved in providing more spacing among antenna elements transmitting and/or receiving wireless signals in the same radio frequency (RF) band. Furthermore, improved polarization and pattern diversity may be achieved by minimizing correlation among antenna elements through an arrangement of antenna elements in different orientations and reducing Envelope Correlation Coefficient (ECC) by varying directional patterns.

Herein, certain terminology is used to describe features of the disclosure. For example, the term "logic" is generally defined as hardware and/or software. As hardware, logic may include circuitry such as processing circuitry (e.g., a microprocessor, a programmable gate array, a controller, an application specific integrated circuit, etc.), wireless receiver, transmitter and/or transceiver circuitry, semiconductor memory, combinatorial logic, or the like. As software, the logic may be one or more software modules, which are executable code such as an application, an applet, a routine, or one or more instructions. Software modules may be stored in any type of memory, namely suitable storage medium such as a programmable electronic circuit, a semiconductor memory device including a volatile memory (e.g., random access memory, etc.), any type of non-volatile memory (e.g., read-only memory, flash memory, a hard drive, etc.), a portable memory device (e.g., an optical disk, a Universal Serial Bus "USB" flash drive), or the like.

A "wireless network device" generally represents an electronic unit that supports wireless communications such as an Access Point (AP), a station (e.g., any data processing equipment that is operable by a user such as a computer, cellular phone, personal digital assistant, tablet computer, etc.), a data transfer device (e.g., wireless network switch, wireless router, brouter, etc.), or the like.

An "interconnect" is generally defined as a communication pathway established over an information-carrying medium. This information-carrying medium may be a physical medium (e.g., electrical wire, optical fiber, cable, bus traces, etc.), a wireless medium (e.g., air in combination with wireless signaling technology), or a combination thereof.

Lastly, the terms "or" and "and/or" as used herein are to be interpreted as inclusive or meaning any one or any combination. Therefore, "X, Y or Z" or "X, Y and/or Z" mean "any of the following: X; Y; Z; X and Y; X and Z; Y and Z; X, Y and Z." An exception to this definition will occur only when a combination of elements, functions, steps or acts are in some way inherently mutually exclusive.

Certain details are set forth below in order to provide a thorough understanding of various embodiments of the disclosure, albeit the invention may be practiced through many embodiments other that those illustrated. Well-known logic and operations are not set forth in detail in order to avoid unnecessarily obscuring this description.

I. Network Architecture

Referring to FIG. 1, an exemplary embodiment of a network 100 implemented with a wireless network device 110 deploying an antenna dome array 150 is shown. In accordance with one embodiment of the disclosure, network 100 operates as a wireless local area network (WLAN) that features one or more wireless network devices, such as access points (APs) 110-112 for example.

As shown in this embodiment, AP 110 comprises logic, implemented within a casing 120, that controls wireless communications with other wireless network devices (STAs) $\mathbf{130}_1$-$\mathbf{130}_r$ (where r≥1, r=3 for this embodiment) and/or wired communications over interconnect 140. Although not shown, interconnect 140 further provides connectivity for network resources such as servers for data storage, web servers, or the like. These network resources are available to network users via STAs $\mathbf{130}_1$-$\mathbf{130}_r$ of FIG. 1, albeit access may be restricted.

More specifically, for this embodiment of the disclosure, each AP 110-112 supports bi-directional communications by receiving wireless messages from any STAs $\mathbf{130}_1$-$\mathbf{130}_r$ within its coverage area. For instance, as shown as an illustrative embodiment of a network configuration, STA $\mathbf{130}_1$ may be associated with AP 110 and communicates over the air in accordance with a selected wireless communications protocol. Hence, AP 110 may be adapted to operate as a transparent bridge connecting together a wireless and wired network.

Of course, in lieu of providing wireless transceiver functionality, it is contemplated that AP 110 may only support unidirectional transmissions thereby featuring only receive (RX) or transmit (TX) functionality.

II. Wireless Network Device With Antenna Array Dome

Figure 2:
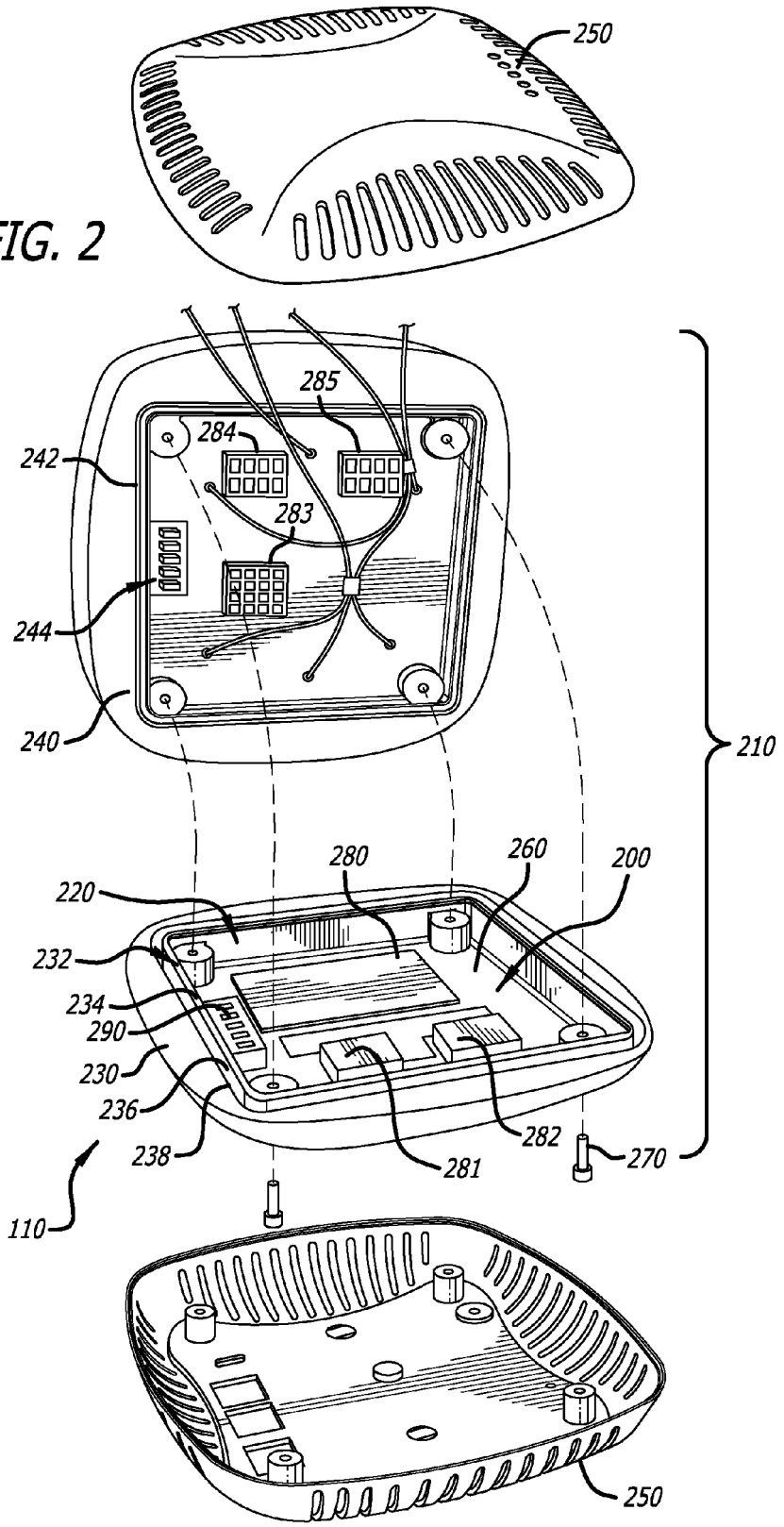
FIG. 2 is an exploded view of a first exemplary embodiment of the wireless network device of FIG. 1.

Referring now to FIG. 2, an exploded view of an exemplary embodiment of wireless network device 110 (e.g., AP 110) of FIG. 1 is shown. Herein, wireless network device 110 comprises wireless logic 200 encased by a heat dissipation unit 210 (e.g., a heat sink) that, in turn, is surrounded by a casing 250. According to this embodiment of the disclosure, heat dissipation unit 210 comprises a base section 230 and a cover section 240.

More specifically, wireless logic 200 is contained within a cavity 220 formed by base section 230 of heat dissipation unit 210. A cover section 240, forming part of an antenna dome array (described below), is placed over and rests upon an opening edge 232 of base section 230. Both base section 230 and cover section 240 of heat dissipation unit 210 are made of a heat-radiating material in order to dissipate heat by convection. For example, this heat-radiating material may include aluminum or any other metal, combination of metals or a composite that conducts heat.

As further shown in FIG. 2, wireless logic 200 comprises a circuit board 260 that is sized for placement within cavity 220 of concave-shaped base section 230. According to one embodiment of the disclosure, circuit board 260 is positioned below a first flange 234 that extends around opening edge 232 of base section 230 and secured by one or more fastening elements 270 (e.g., boss and screw/bolt, lock and insertion pin, etc.). First flange 234 creates a recessed groove 236 with an edge portion 238 of base section 230.

Additionally, according to one embodiment of the disclosure, cover section 240 of heat dissipation unit 210 is configured with a convex shape that is sized for mating with base section 230. For instance, a second flange 242 extends around an inner periphery of cover section 240 so that second flange 242 rests in recessed groove 236 formed between first flange 234 and edge 238 of base section 230.

A heat transfer path from wireless logic 200 to base section 230 and/or cover section 240 is provided by thermal elements 280-282. These elements 280-282 are positioned so that wireless logic 200 establishes thermal contact with cover section 240 and/or base section 230 when circuit board 260 is situated in base section 230 and cover section 240 is placed over base section 230.

Herein, a plurality of light emitting diodes (LEDs) 290 are positioned on or proximate to circuit board 260 and aligned with apertures 244 placed within cover section 240. This enables emission of light to represent status information concerning wireless network device 110 (e.g., state of operation, level of work load, etc.).

Figure 3:
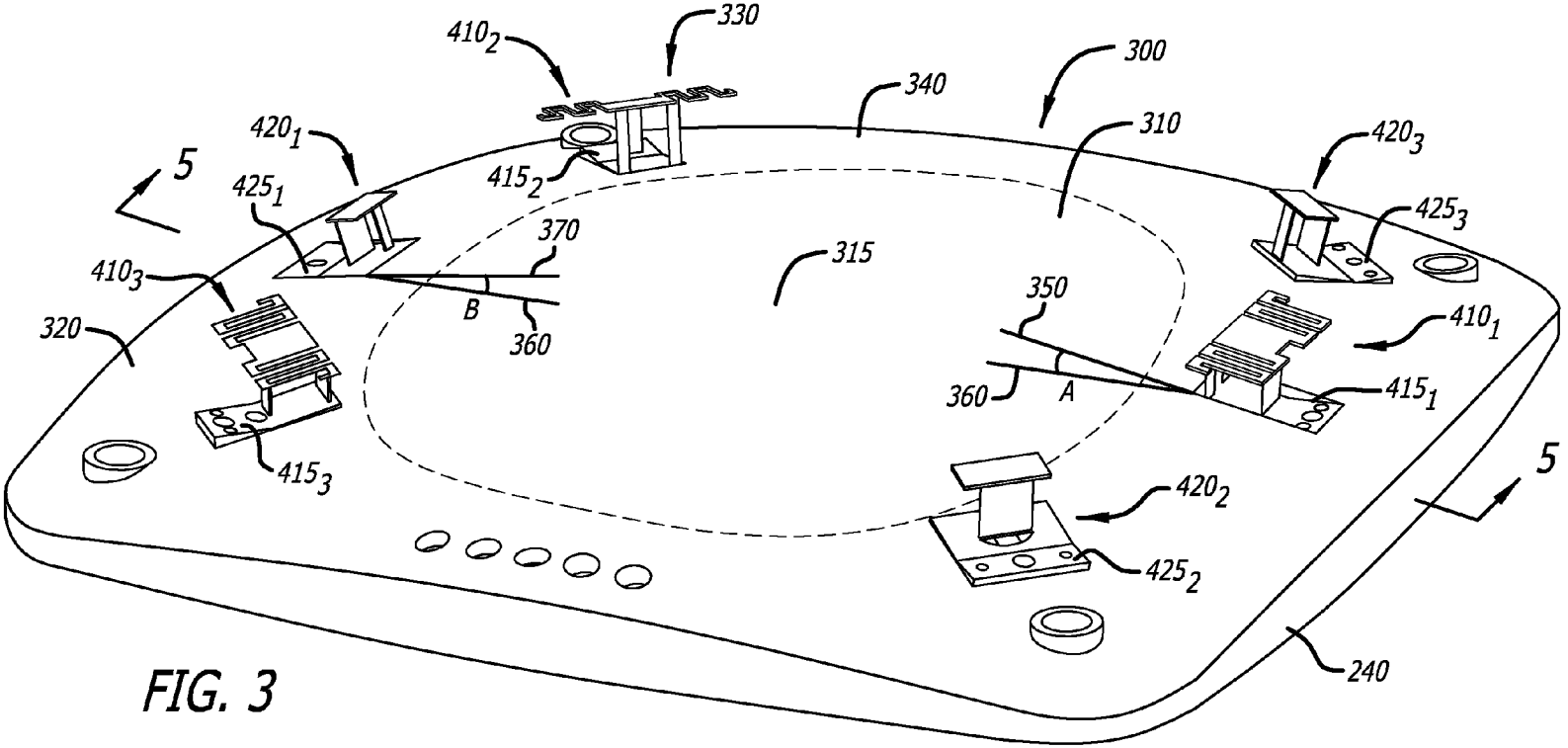
FIG. 3 is a perspective view of an antenna dome array of the wireless network device of FIG. 1.

Referring now to FIG. 3, a perspective view of an antenna dome array 300 of wireless network device 110 is shown. Herein, formed using cover section 240, antenna dome array 300 comprises a center area 310 and a curved, outer periphery 320 that, alone or in combination with center area 310, provides its convex shape. A plurality of antenna elements 330 are positioned along outer periphery 320 to form antenna dome array 300. The radius of curvature for segment of outer periphery 320 may range from R400-R550. According to this embodiment of the invention, the radius of curvature lies within a sub-range of R474 as described below.

Figure 4:
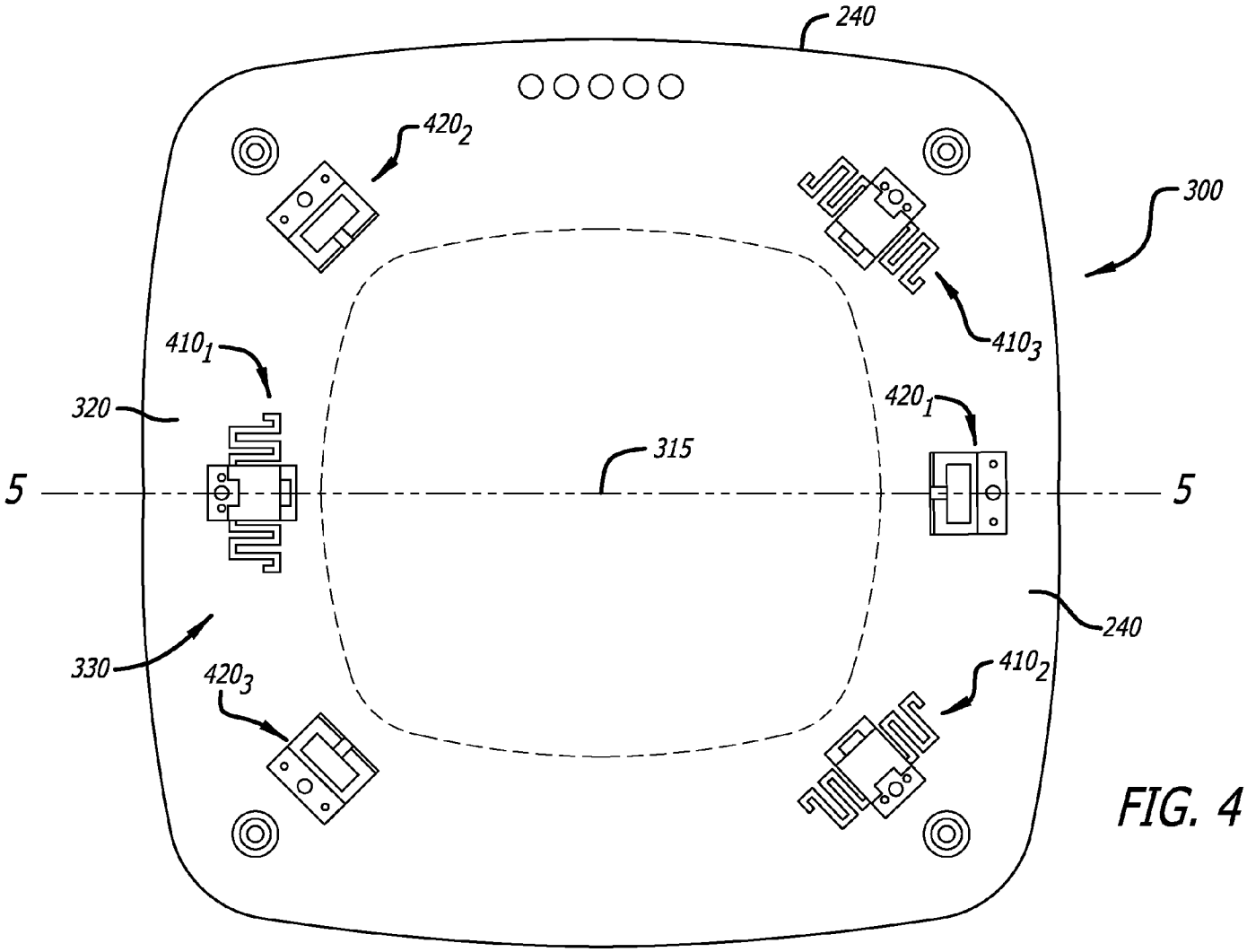
FIG. 4 is a top plan view of antenna dome array of FIG. 3.

Referring now to FIG. 4, a top plan view of antenna dome array 300 of FIG. 3 is shown. Herein, antenna elements 330 comprise a first plurality of antenna elements $\mathbf{410}_1$-$\mathbf{410}_n$ (where n≥2, n=3 for this embodiment) operating in a first frequency band (e.g., 2.4 gigahertz "GHz") and a second plurality of antenna elements $\mathbf{420}_1$-$\mathbf{420}_m$ (where m≥2, m=3 for this embodiment) operating in a second frequency band (e.g. 5 GHz). More specifically, a first antenna element $\mathbf{410}_1$ operating in the first frequency band is positioned on outer periphery 320 opposite from first antenna element $\mathbf{420}_1$ operating in the second frequency band. Similarly, second and third antenna elements $\mathbf{410}_2$ and $\mathbf{410}_3$ operating in the first frequency band are positioned on outer periphery 320 substantially opposite from positions of second and third antenna elements $\mathbf{420}_2$ and $\mathbf{420}_3$ operating in the second frequency band.

Furthermore, according to one embodiment of the disclosure, each antenna element $\mathbf{410}_1$, $\mathbf{410}_2$ and $\mathbf{410}_3$ may be separated from each other by a uniform degree of separation. In other words, using a center point 315 of cover section 240 as a reference point, each antenna element operating in the same frequency band is separate from its neighboring antenna element by approximately 360/n degrees (120° for n=3).

According to another embodiment of the disclosure, antenna element $\mathbf{410}_2$ and $\mathbf{410}_3$ may be separated from antenna element $\mathbf{410}_1$ by a first angle of separation while antenna element $\mathbf{410}_2$ and $\mathbf{410}_3$ are separated from each other by a second angle of separation. The first angle of separation is greater than the second angle of separation. For instance, antenna element $\mathbf{410}_2$ and $\mathbf{410}_3$ may have a second angle of separation equal to approximately ninety degree) (90° while the first degree of separation between antenna elements $\mathbf{410}_1$/$\mathbf{410}_2$ and/or $\mathbf{410}_1$/$\mathbf{410}_3$ may be approximately one-hundred thirty-five (135°). Element $\mathbf{420}_1$, $\mathbf{420}_2$ and $\mathbf{420}_3$ are positioned generally opposite from antenna elements $\mathbf{410}_1$, $\mathbf{410}_2$ and $\mathbf{410}_3$, respectively.

Referring back to FIG. 3, antenna dome array 300 comprises antenna elements $\mathbf{410}_1$-$\mathbf{410}_3$ each having a corresponding base member $\mathbf{415}_1$-$\mathbf{415}_3$ affixed to a top surface 340 of outer periphery 320. Furthermore, antenna dome array 300 comprises antenna elements $\mathbf{420}_1$-$\mathbf{420}_3$ with corresponding base members $\mathbf{425}_1$-$\mathbf{425}_3$ affixed to top surface 340 of outer periphery 320. The placement of both antenna elements $\mathbf{410}_1$-$\mathbf{410}_3$ and $\mathbf{420}_1$-$\mathbf{420}_3$ on outer periphery 320 along with their degree of separation provides spatial diversity.

Furthermore, in lieu of placing base members 415$_1$-415$_3$ on a substantially horizontal surface, base members 415$_1$-415$_3$ are placed on a convex-shaped outer periphery that tilts antenna elements 410$_1$-410$_3$ upward by a prescribed angle offset from horizontal. For instance, with respect to antenna element 410$_1$, its base member 415$_1$ is positioned on top surface 340 so that antenna element 410$_1$ is angled at a first angle (A) 350 offset from horizontal 360. Likewise, base member 425$_1$ of antenna element 415$_1$ is positioned on top surface 340 so that antenna element 415$_1$ is angled at a second angle (B) 370 offset from horizontal 360.

According to one embodiment of the disclosure, first angle A 350 may be equal to approximately 14° (e.g.) A≈14.5° with second angle B 370 being equivalent to first angle A 350 (e.g.) B≈14.5°. However, it is contemplated that first angle A 350 may have an angle ranging between 10°-20° and second angle B 370 may have an angle ranging between 10°-20°, where angles A and B may be equivalent to each other or different from one another.

Referring now to FIG. 5, a cross-sectional view of antenna dome array 300 of FIG. 4 along lines 5-5 is shown. Antenna dome array 300 comprises (1) antenna elements 410$_1$ with base members 415$_1$ and (2) antenna elements 420$_1$ with corresponding base members 425$_1$. Both of these base members 415$_1$ and 425$_1$ are affixed to top surface 340 of outer periphery 320 and separated by a distance greater than 65% of a diameter 510 of antenna dome array 300.

According to one embodiment of the disclosure, a distance D1 540 from a first edge 520 of cover section 240 to base member 415$_1$ is approximately equal to 30-34 millimeters (mm) (e.g. 31.6 mm) and a distance D2 550 from a second edge 525 of cover section 240 to base member 425$_1$ is approximately equal to 30-34 mm (e.g., 33.2 mm). Diameter 510 is approximately 190 mm and the distance between base members 415$_1$ and 425$_1$ is approximately 125 mm.

Furthermore, as shown in FIG. 5, the radii of curvature (R1, R2) along different segments of outer periphery 320 may be substantially equivalent, namely: R1 (radius of curvature over D1)≈R2 (radius of curvature over D2). According to another embodiment, the radii of curvature (R1, R2, R3, where "R3" is the radius of curvature near center point 315) may differ so that R3>R1≥R2 or R3>R2≥R1. It is noted that R3>>R1, R2 because the center area around center point 315 may be substantially flat resulting in a much larger radius of curvature than R1, R2 (e.g., R3≈474 while R1, R2≈79).

Hence, as shown in FIG. 5, in lieu of placing base members 415$_1$-415$_3$ on a substantially horizontal surface, base members 415$_1$-415$_3$ are placed on convex-shaped outer periphery 320 with an angular offset from horizontal 360. Hence, first antenna element 410$_1$ produces a first antenna pattern 560 along a first plane 565 while second antenna element 420$_1$ produces a second antenna pattern 570 radiating at an angle different from first antenna pattern 560. Similarly, although not shown, antenna elements 410$_2$ and 410$_3$ produce antenna patterns having propagation patterns that would intersect first plane 565, and antenna elements 420$_2$ and 420$_3$ produce antenna patterns having propagation patterns that would intersect a second plane formed by second antenna pattern 570 and/or first pane 565. This arrangement achieves improved polarization and pattern diversity by placing antenna elements 410$_1$-410$_3$ in different orientations (e.g. different direction and/or different angles offset from horizontal).

FIG. 6 is a perspective view of a second exemplary embodiment of antenna dome array 300 of FIG. 3. Herein, the antenna elements comprise a first plurality of antenna elements 410$_1$-410$_n$ (where n=2 for this embodiment) operating in the first frequency band and a second plurality of antenna elements 420$_1$-420$_m$ (where m=2 for this embodiment) operating in the second frequency band.

According to one embodiment of the disclosure, first antenna element 410$_1$ is positioned on a corner 600 of outer periphery 320 opposite from a corner 610 featuring second antenna element 410$_2$. Similarly, antenna elements 420$_1$ and 420$_2$, which operate in the same frequency band, are positioned on different corners 620 and 630 of outer periphery 320. Hence, each antenna element operating in the same frequency band (e.g., antenna elements 410$_1$-410$_2$ and antenna elements 420$_1$-420$_2$) is separated from each other by a uniform degree of separation. In other words, using a center point 640 of cover section 240 as a reference point, each antenna element operating in the same frequency band is separated from its neighboring antenna element by approximately 180° degrees and placed within the corner for maximum spatial separation.

Figure 7:
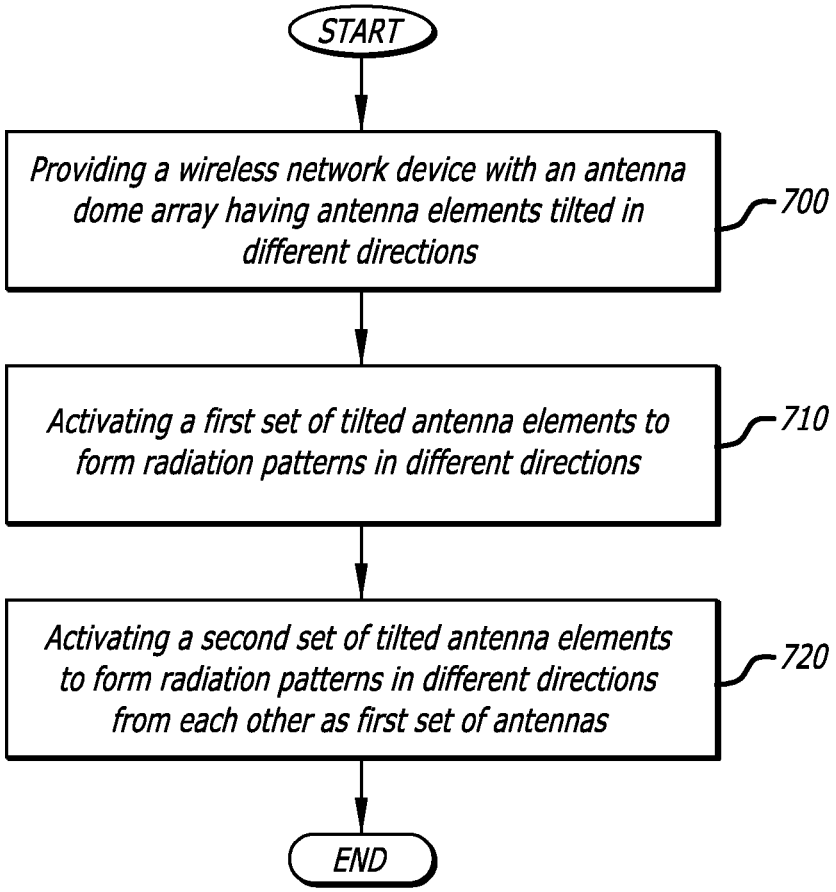
FIG. 7 is an exemplary flowchart of the operations of the antenna dome array.

Referring to FIG. 7, an exemplary flowchart of the operations of the antenna dome array is shown. Initially, a wireless network device is provided with an antenna dome array with antenna elements angularly tilted in different directions (block 700). A first set of tilted antenna elements is activated to produce one or more radiation patterns (block 710). These radiation patterns may be in different directions and along different planar paths. Furthermore, a second set of tilted antenna elements is activated to produce one or more radiation patterns (block 720). These radiation patterns may be in different directions and along different planar paths with respect to each other as well as the radiation patterns produced by the first set of tilted antenna elements.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as determined by the appended claims and their equivalents. The description is thus to be regarded as illustrative instead of limiting.

What is claimed is:

1. A wireless network device, comprising:

wireless logic; and a heat dissipation unit encasing the wireless logic, the heat dissipation unit including an antenna dome array that comprises a top surface having a convex-shaped outer periphery with a plurality of antenna elements positioned along the outer periphery.

2. The wireless network device of claim 1, wherein the wireless logic comprises a circuit board including a processor.

3. The wireless network device of claim 1, wherein the plurality of antenna elements include a plurality of first antenna elements operating in a first frequency band and a plurality of second antenna elements operating in a second frequency band different than the first frequency band.

4. The wireless network device of claim 3, wherein each of the plurality of second antenna elements is positioned along the convex-shaped outer periphery between two neighboring first antenna elements of the plurality of first antenna elements.

5. The wireless network device of claim 3, wherein each of the plurality of first antenna elements operate in the first frequency band being a 2.4 gigahertz band and each of the plurality of second antenna elements operate in the second frequency band being a 5 gigahertz band.

6. The wireless network device of claim 3, wherein the plurality of first antenna elements are positioned on the top surface having the convex-shaped outer periphery at a first angle so as to produce radiation patterns offset from horizontal by the first angle.

7. The wireless network device of claim 6, wherein the plurality of second antenna elements are positioned on the top surface having the convex-shaped outer periphery at a second angle so as to produce radiation patterns offset from horizontal by the second angle.

8. The wireless network device of claim 6, wherein the first angle is equal to the second angle.

9. The wireless network device of claim 1 being an access point and further comprising a casing completely surrounding the heat dissipation unit.

10. An apparatus comprising:

a cover having a center area and a convex-shaped outer periphery;

a plurality of antenna elements positioned along a top surface of the outer periphery of the cover, the plurality of antenna elements including a plurality of first antenna elements operating at a first frequency band and a plurality of second antenna elements operating at a second frequency band greater than the first frequency band, wherein at least one of the plurality of first antenna elements are positioned on the top surface at a first angle offset from horizontal so as to produce a radiation pattern offset from the horizontal by the first angle.

11. The apparatus of claim 10, wherein at least one of the plurality of second antenna elements is positioned on the top surface at a second angle offset from horizontal so as to produce radiation patterns offset from horizontal by the second angle.

12. The apparatus of claim 11, wherein the first angle is equal to the second angle.

13. The apparatus of claim 10, wherein the plurality of antenna elements are coupled to wireless logic mounted on a circuit board positioned under the cover.

14. The apparatus of claim 10, wherein each of the plurality of second antenna elements is positioned along the convex-shaped outer periphery between two neighboring first antenna elements of the plurality of first antenna elements.

15. The apparatus of claim 14, wherein the plurality of first antenna elements are operating in the first frequency band being a 2.4 gigahertz band and the plurality of second antenna elements are operating in the second frequency band being a 5 gigahertz band.

16. An access point, comprising:

a casing;

a heat dissipation unit encasing by the casing, the heat dissipation unit including an antenna dome array that comprises a top surface having a convex-shaped outer periphery with a plurality of antenna elements positioned along the outer periphery, the plurality of antenna elements including a plurality of first antenna elements operating at a first frequency band and a plurality of second antenna elements operating at a second frequency band greater than the first frequency band, wherein at least one of the plurality of first antenna elements are positioned on the top surface at a first angle offset from horizontal so as to produce a radiation pattern offset from the horizontal by the first angle.

* * * * *